United States Patent [19]

Saylor et al.

[11] 4,064,503

[45] Dec. 20, 1977

[54] CHANGEABLE PRINTED ALPHANUMERIC DISPLAY MODULE

[75] Inventors: William H. Saylor, South Laguna; James O. Narey, Westminster, both of Calif.

[73] Assignee: Associated Data Concepts, Costa Mesa, Calif.

[21] Appl. No.: 637,433

[22] Filed: Dec. 3, 1975

Related U.S. Application Data

[63] Continuation-in-part of Ser. No. 546,696, Feb. 3, 1975.

[51] Int. Cl.[2] ..... G09F 11/18

[52] U.S. Cl. ..... 340/325; 40/31; 40/93; 340/324 R; 340/334; 340/379

[58] Field of Search ..... 340/324, 325, 379, 334; 40/31, 52 R, 46, 92, 93, 117, 82–86, 347, 106.51, 106.52, 106.53

[56] References Cited

U.S. PATENT DOCUMENTS 1,016,944 2/1912 Kent ..... 40/31

*Primary Examiner*—Marshall M. Curtis

*Attorney, Agent, or Firm*—Reising, Ethington, Barnard

[57] ABSTRACT

A changeable printed alphanumeric display module is disclosed for displaying one character at a time in a viewing window. Each tape of a set of tapes is printed on both front and back surfaces with character segments and is connected between a driving roller and a driven roller in a manner to display one front surface segment and one back surface segment at a time. The tape segments which carry the respective character segments are progressively longer from one end of the tape to the other and the set of tape segments which are displayed together in the window all bear different character segments of the same character so that an entire character is displayed. All tapes in the set are driven in unison to successively present the character segments of each tape in registry with respective window segments.

4 Claims, 11 Drawing Figures

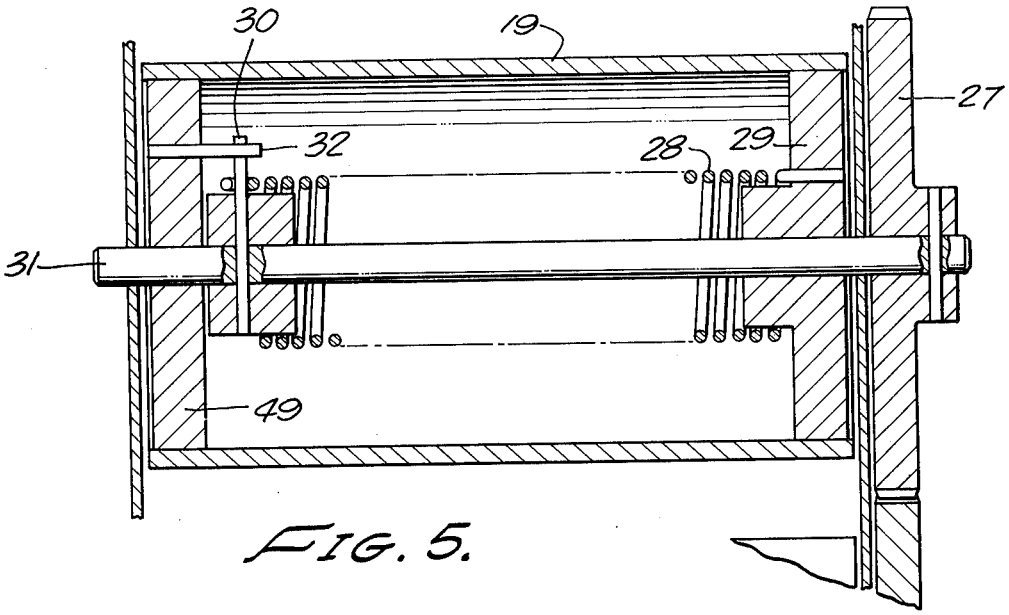
FIG. 5.
FIG. 7.
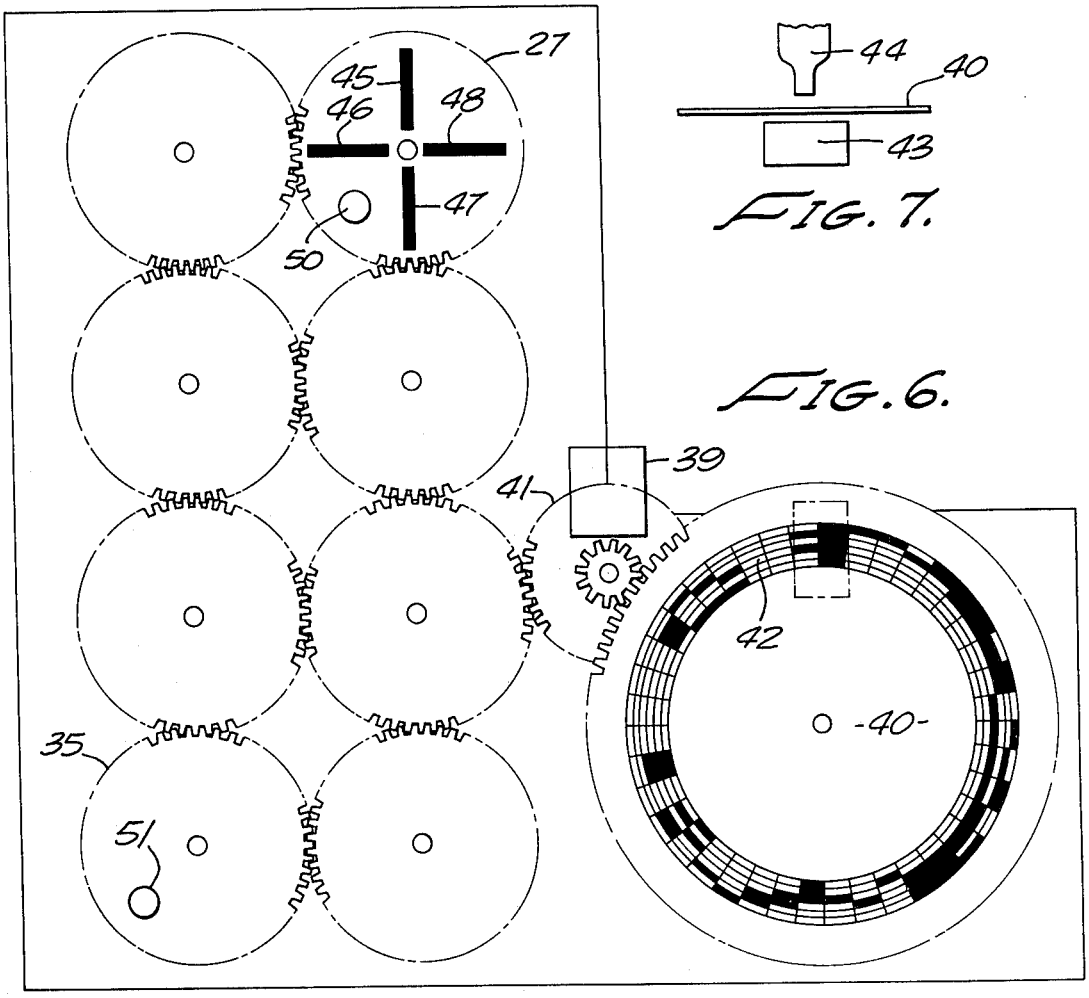
FIG. 6.

CHANGEABLE PRINTED ALPHANUMERIC DISPLAY MODULE

FIELD OF THE INVENTION

This invention relates to information displays and particularly to such displays as are capable of presenting any of a number of alphanumeric displays. This is a continuation-in-part of our application Ser. No. 546,696 filed Feb. 3, 1975.

BACKGROUND OF THE INVENTION

The problem of presenting a readily changeable alphanumeric readout in a small space has been solved in many different fashions, as exemplified by neon-glow-discharge tubes, liquid crystal readouts, solid-state electroluminescent devices, and the like. Most such arrangements require operating signals which themselves contain most or all of the information to be displayed, and in any case are in general poorly adapted to large scale readouts, such as may be seen readily from a considerable distance. Further, a general problem with light-emitting displays is illegibility when the ambient light level is high. Opaque displays, in contrast, increase in visibility as the ambient light increases.

A need exists for a mechanically sound, readily and quickly changeable and accurate display for such diversified uses as destination indicators for buses, advertising signs, indicators of ambient temperature, time of day, and the like.

In particular, there is a need for a changeable display device for alphanumeric characters wherein one whole character is displayed at a time. While this can be done by using a tape and roller mechanism with whole characters printed on the tape in succession from one end to the other, a long tape is required and the change from a character at one end to a character at the opposite end of the tape is time consuming and poses other problems. The subject invention is addressed to this problem and to the problem of changing a display from one single alphanumeric character to another with faithful reproduction of the character configurations of a given font of characters.

THE PRIOR ART

In the prior art, changeable printed signs are predominantly of the roller-curtain type, such as those illustrated in the Pierce, U.S. Pat. No. 354,929 and the Morrone, U.S. Pat. No. 1,196,136. In these devices a single roller-curtain carries a number of words which are selectively displayed through a viewing window. It is known in such devices to print words on both sides of the curtain. Changeable printed displays are also known in which a picture is formed by a set of roller-curtains each of which, in a given position, displays a segment of the picture, as disclosed in the Kent, U.S. Pat. No. 1,016,944. This apparatus uses roller-curtains as wide as the entire picture. Each roller-curtain may provide two segments of the picture by imprinting both surfaces of the roller-curtain. The curtain extends between driving and driven rollers with each segment being looped over a pair of display rollers.

The Swedish patent number 42,928 shows the use of plural roller-curtains for showing alphabetic characters in a segmented display. In this patent a pair of curtains is wound upon each set of driving and driven rollers; plural driving rollers, and hence a set of curtain pairs are driven in unison by a common driving shaft. Each curtain of the set carries segments of two alphabetic characters.

The difficulty with the prior art described above is that there is no way to change one character of the display without changing the other characters of the display. The Doser, U.S. Pat. No. 3,582,937 shows an alphanumeric display sign with multiple character displays, each of which can be changed independently of the other. However, in this device, a tape bearing a set of characters is provided in each window area and each character is shown in its entirety. The tape is movable to display selectively any one of the characters imprinted on the tape. The difficulty with this device is that each tape has to be long enough to accommodate a full set of whose characters.

Other prior art is represented by the following United States Pat. Nos.

Knight, 388,980;
Farrand, 762,519;
Tatosian, 1,301,620;
Archipenko, 1,262,497;
Hoetger, 1,764,683;
Morrison, 1,894,960;
Llobet, 3,299,551;
Pipe, 3,389,483;
Mobet, 3,585,745.

The prior art is further represented by Italian patent number 527,997.

SUMMARY OF THE INVENTION

An object of the present invention is to provide a readily changeable display device adapted to displaying letters and numerals within the framework of a mechanically sound apparatus.

Another object of the invention is to provide such a device including positioning means whereby the display may be selectively changed to any desired configuration, and is especially well adapted to positioning by automatic devices, particularly those under computer or machine control.

According to this invention, a changeable display of printed alphanumeric characters is provided which faithfully reproduces each character, one at a time with a minimum of translatory motion required in changing from one character to another. In general, this is accomplished by using a set of display tapes with each tape bearing discrete character segments which are imprinted on both front and back surfaces of the tape. A driving roller is connected with one end of each tape and a driven roller is connected with the other end, and the tape is supported for displaying one surface segment of the front and of the back of each tape in respective segments of each window. The set of surface segments being displayed together in the window all bear different character segments of the same character so that an entire character is displayed. Means are provided for displacing the tapes in unison along their length to successively present the character segments in registry with the respective window segments whereby all characters of the set may be successively displayed. The number of display tapes in the set is equal to one-half the number of character segments. The length required for each tape varies inversely with the number of segments which is chosen to make up each full character.

Further, in accordance with the invention, faithful reproduction of the characters is provided by means which ensures proper positioning of the character segments within the respective window segments. This is accomplished by placing the character segments on respective surface segments of the tape with the surface segments being progressively longer from one end of the tape to the other to allow for wrap-up of the tape on the rollers. Further, the character segments are nonuniformly spaced along the length of the tape so that equal angular displacements of the driving roller causes proper alignment of the character segments in the window segments.

Further, according to the invention, the proper positioning of the character segments is enhanced by relating the roller size to the length of character segments. In particular, the diameter of the rollers should be approximately equal to the length of two character segments.

Further, according to the invention, the display of each character, even though it is a composite of several segments, is produced without distortion. For this purpose the number of character segments is selected so that the horizontal bars of a character may be carried all on one segment and yet be properly located in the character format. Preferably, the numnber of character segments is eight. Additionally, distortion between adjacent segments is minimized by fairing of the character line at the upper and lower extremities of the segments.

Further, according to the invention, the driving and driven rollers are disposed in a minimum of space and may be driven by a single input shaft so the rollers move only in unison. This is accomplished by placing the driving roller of each set behind the display window and the driven roller immediately behind the driving roller with equal size gears on all rollers and meshing with at least one adjacent gear.

DETAILED DESCRIPTION

A more complete understanding of this invention may be obtained from the detailed description that follows, taken with the accompanying drawings in which:

Figure 3A:
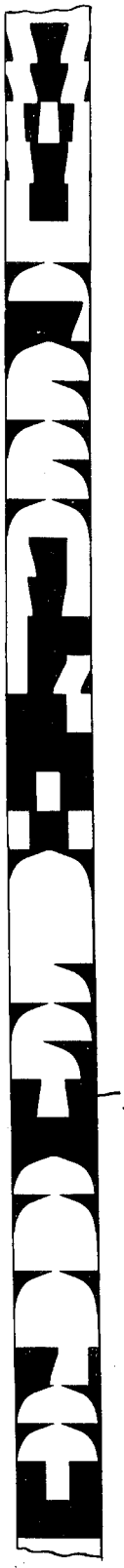
Figure 3B:
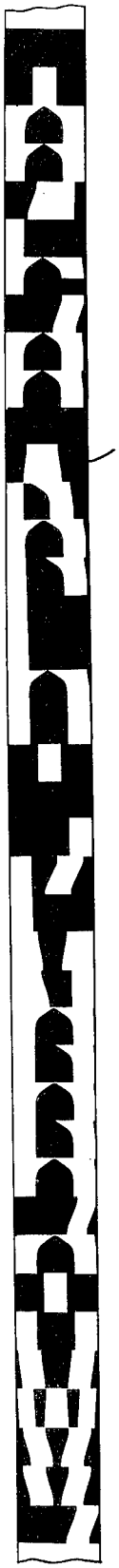
Figure 4:
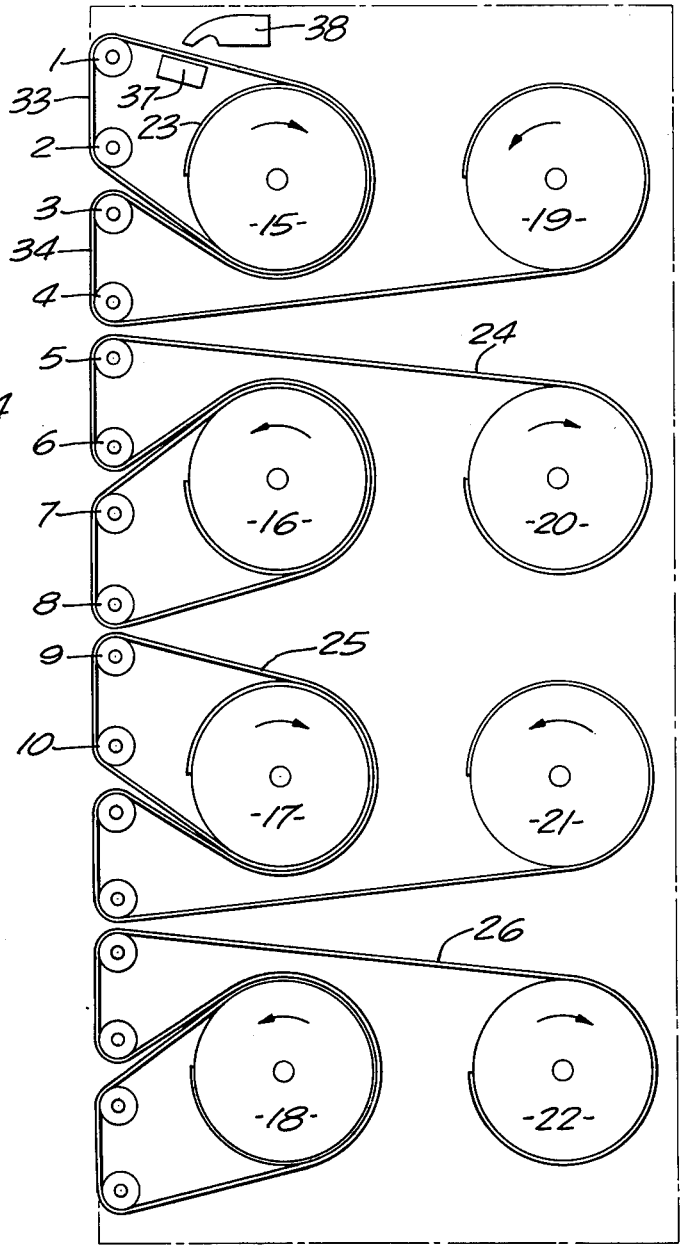
Figure 8:
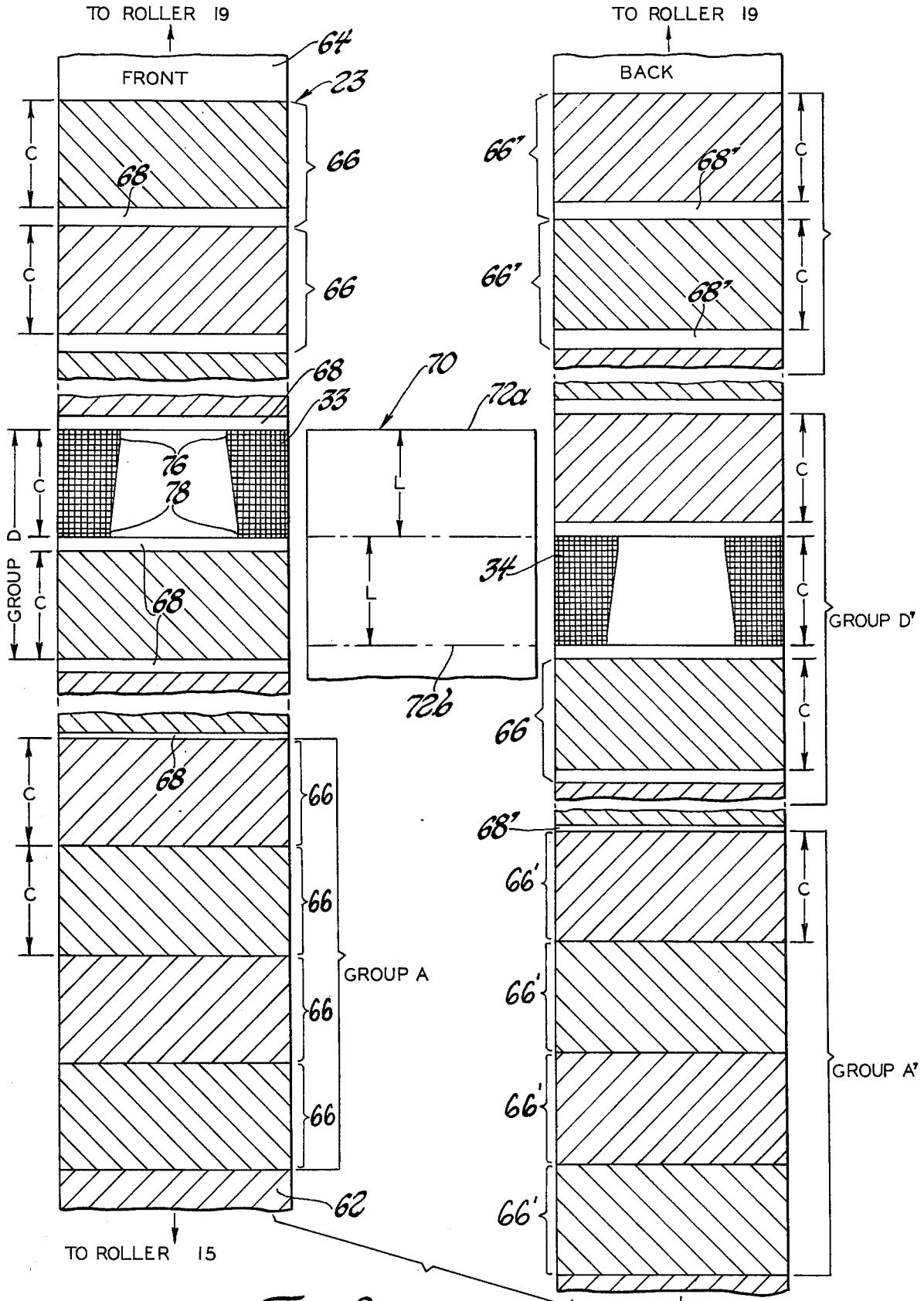
Figure 9:
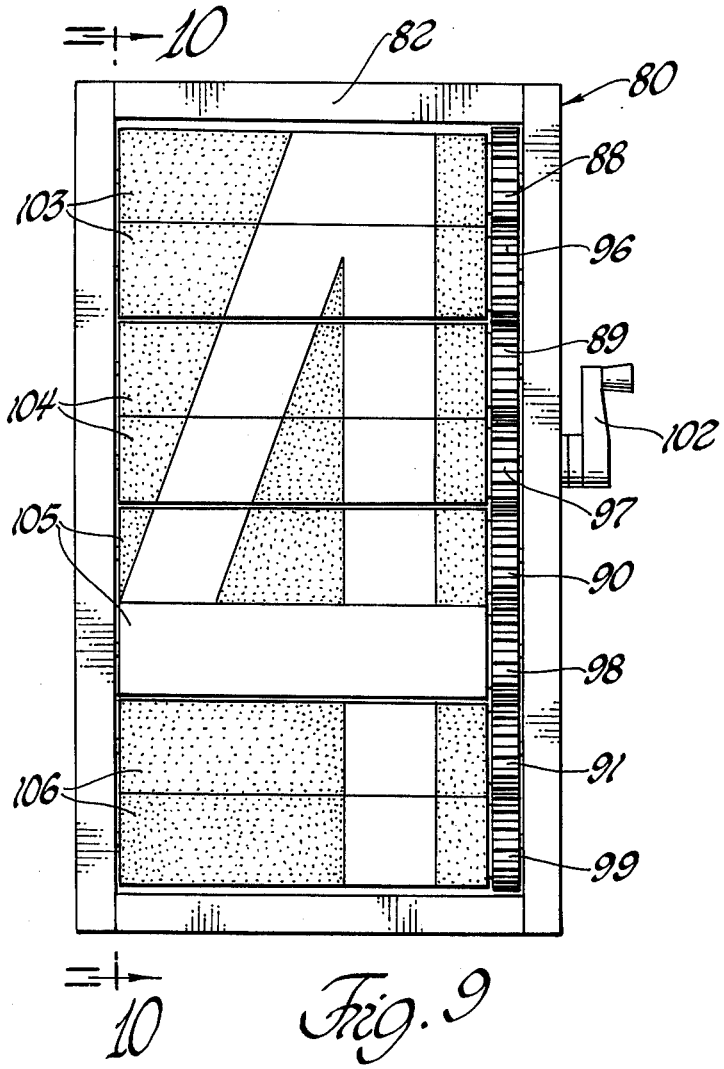

FIGS. 3*a* and 3*b* are respectively the front and back sides of a display tape such as may be used in the device;

FIG. 4 is a diagrammatic side view of the device showing the winding mode of the display tape on the rollers;

FIG. 5 is a sectional view showing the detailed construction of a slave roller;

FIG. 6 is a diagrammatic side view showing the intermeshing coupling means whereby the driving rollers are rotated and showing an optional positioning code disc;

FIG. 7 is a top fragmentary view of the code disc shown in FIG. 6;

FIG. 8 is a diagrammatic showing of the relative positioning of the character segments on the tape;

FIG. 9 shows a modification of the invention; and

Figure 10:
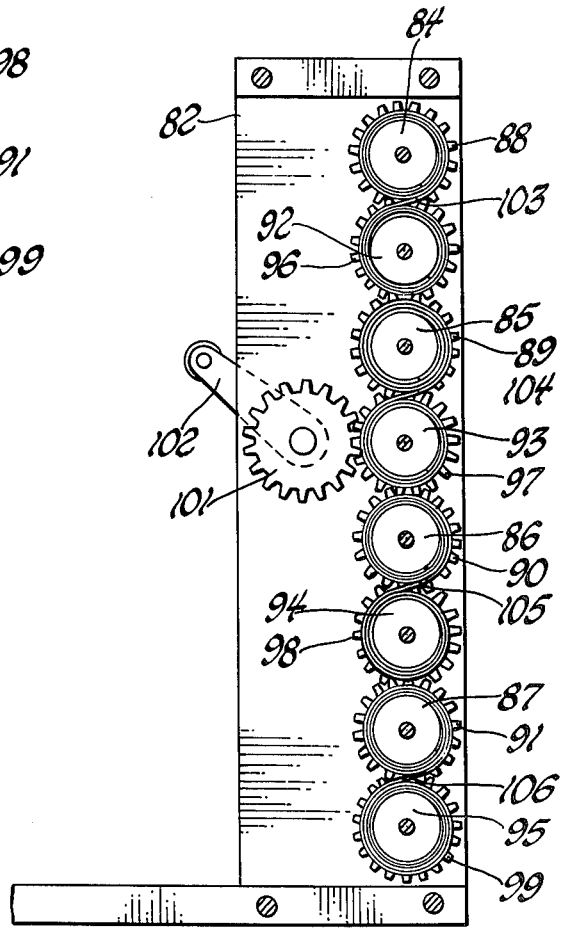

FIG. 10 is a sectional view taken on lines 10—10 of FIG. 9.

Figure 2:
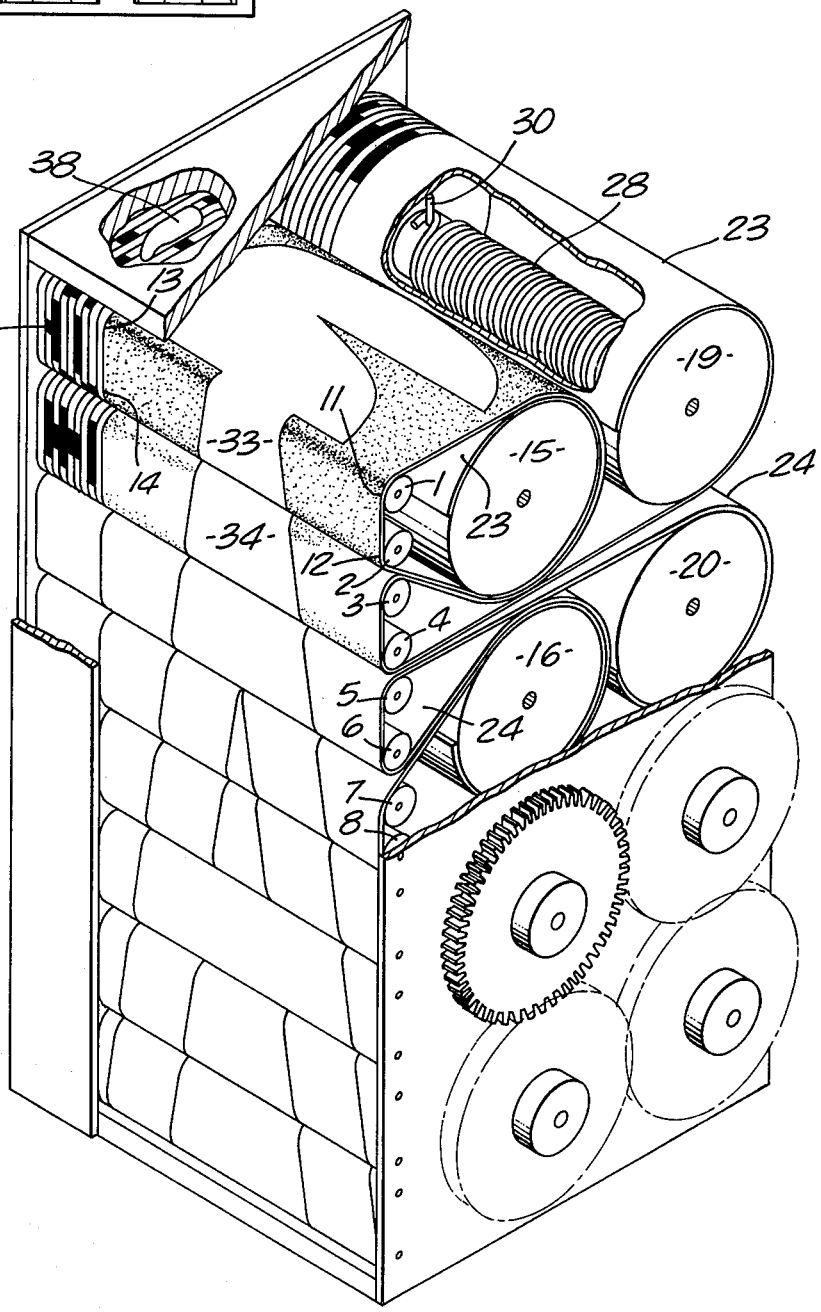
FIG. 2 is a partially cut-away perspective view of a typical embodiment of the invention display unit.

Coming now to FIGS. 2 and 4, it will be seen that the device or module comprises an array of display rollers, 1, 2, 3, 4, 5, 6, 7, 8, 9, 10, etc. which are arranged in spaced pairs, 1,2; 3,4; etc., and in which two adjacent pairs form groups of four rollers each, such as 1–4 inclusive, 5–8 inclusive, and so forth. Furthermore, all of the axes of the cylindrical display rollers 1, 2, 3, etc., are in the same plane so that all of the cylindrical display rollers are tangent to a display plane, the position of this tangent display plane being indicated in the drawings by those segments of the tapes which lie flat on the front of the display device, as shown, for example, in FIG. 2 by that portion of the uppermost tape lying between the points indicated as 11, 12, 13 and 14.

Figure 1:
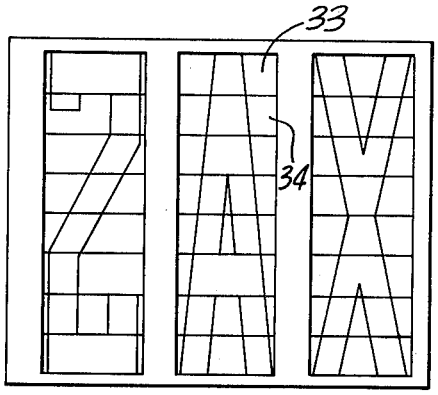
FIG. 1 is a front view of three display units in accordance with the invention, each exhibiting a different numeral or figure.

It will be apparent from the drawings and in particular from FIGS. 1 and 2 that those portions of the display tapes visible from the outside form an array of essentially horizontal segments which may be viewed as a whole, thus for example in FIG. 2 displaying the letter "A" made up of eight horizontal segments.

Reverting now to FIG. 4, this illustrates the fashion in which the tapes are wound on and over their respective rollers. Each group of four display rollers, 1–4, 5–8, 9–12, etc., is backed up by a driving roller 15, 16, 17 and 18, and by a slave roller 19, 20, 21 and 22. A tape 23 is fastened at one end to the driving roller 15, and after looping over the back of the driving roller is threaded over display rolles 2 an 1 and thence back over driving roller 15 and thence is threaded over display rollers 3 and 4 and is finally taken up by slave roller 19, to which its opposite end is fastened.

It will be observed that in passing over display rollers 1 and 2, one face of the tape 23 is exposed to view, whereas when the tape passes over display rollers 3 and 4 the back or reverse side of the same tape is displayed.

It will be further noted that the next unit in the stack comprising display roller 5, 6, 7 and 8, driving roller 16 and slave roller 20, has its own tape 24. The same is true for the remaining units in this stack involving driving rollers 17 and 18, slave rollers 21 and 22, and tapes 25 and 26 respectively. Further, proceeding from the top of the stack downward each successive driving roller together with all the rollers actuated thereby rotates in a sense opposite to that of its neighbor next below, for reasons which will appear later In the embodiment shown in the drawings, four units are shown in a vertical stack. It will be clear that more or fewer could be used in accordance with the nature of the information to be displayed. Likewise, FIG. 1 shows three such four-stack arrays in horizontal juxtaposition. This enables the information on each of the three devices to be varied independently of the others, which in some instances is advantageous, as for example when various numbers or various words are to be shown. Clearly, if for example 20 devices are assembled in a horizontal array and if each device can display each of the 26 letters of the alphabet and the 10 digits from 0 to 9, then any word of up to 20 letters or any digit up to $1 \times 10^{20} - 1$ can be displayed at will.

Reverting once more to the drawings, the slave rollers 19, 20, 21 and 22 are take-up rollers which serve to wind up, or as the case may be, to unwind the tape when the display is changed. All of the driving rollers 15, 16, 17 and 18 and the slave rollers 19, 20, 21 and 22 are geared together as may be seen from FIG. 6, and because of the relative sense of rotation of the various rollers this may be done in the extraordinarily simple fashion shown in FIG. 6. Thus, all of the gears are meshed together at their points of contact, which leads to a complete avoidance of any slippage problems which might otherwise cause the tapes in a given stack to become out of phase. As a given tape is wound from its driving roller on to its slave roller, or contrariwise, it will be clear that a given amount of angular rotation will correspond to a slightly varying linear payout or uptake because of the finite thickness of the wound tape. We compensate for this slight disparity in the required angular rotation between a given driving roller and its slave roller by providing a spring loading in torque for each slave roller, as may be seen from FIG. 5. It will be clear from that drawing that the gear 27 does not drive the roller 19 directly and positively but only through the intermediary of helical spring 28, which is set so as to impart a moderate degree of tension in the tape. Spring 28 is engaged at one end to endpiece 29 forming part of the slave roller 19; whereas at the other end it engages anchor pin 30 which is fixedly attached to the drive shaft 31 which in turn is fixedly attached to gear wheel 27. A stop pin 32 is attached to endpiece 49 of slave roller 19, and serves to limit the rotation of shaft 31 with respect to slave roller 19. It serves to hold the spring 28 from being over-stressed during operation if the tape or roller should stick. This arrangement of course is repeated for each unit in the stack.

It will be clear from the foregoing, and particularly from FIG. 2, that the array of gears attached to the driving rollers are not only intermeshed with each other, but are also intermeshed with the array of gears which are attached to the slave rollers, and both arrays are intermeshed so that all of the gears may only rotate in unison, taking into account the opposite senses of rotation of adjacent gears. Thus each driving roller gear engages at least one other driving roller gear as well as its corresponding slave roller gear; and the same may be said for each of the slave roller gears, each one of these engaging at least one other slave roller gear while at the same time engaging its corresponding driving gear.

Turning for the moment to FIGS. 3*a* and 3*b*, these show respectively the front and back sides of tape 23, which as will be appreciated from the foregoing explanation has, depending upon the particular setting of the device, a segment of one side displayed between display rollers 1 and 2, and another segment from the other side displayed between the display rollers 3 and 4. FIG. 1 shows the setting of the device so as to display the letter "A." In FIG. 3*a*, that segment forming the top half of the upper one quarter of the letter "A" is indicated by 33; whereas that portion of the reverse of the tape shown on FIG. 3*b* which forms the lower half of the uppermost one quarter of the letter "A" is indicated by 34. The tape shown in FIGS. 3*a* and 3*b* bears sufficient markings to form the upper one quarter portion, that is, between rollers 1 and 4, of all 26 letters of the alphabet, all ten digits from 0 through 9, a period (.), a dash (-), a slash (/), and a blank space.

It may be remarked that for convenience in explaining our invention we have shown the various rollers as horizontal, with the stacking vertical; but the terms "horizontal" and "vertical" are used mainly for convenience. It is self-evident that the entire apparatus shown may be rotated through 90°, so that the rollers will then be vertically disposed. Obvious changes will then have to be made in the arrangement of the subject matter to be displayed, except in the infrequent case that the material consists of symbols having four-fold symmetry, such as circles, plus signs, crosses of equal arm length and the 1, 4 and 5 spots on dice and the like.

A closed-loop positioning system may be employed for automatic selection of the desired character display. In the device of FIGS. 2 and 4, the uppermost tape 23 bears a coded endstrip 36 in the portion shielded from view. This strip bears positioning markers in an array of parallel channels, the markings consisting of opaque portions in an otherwise transparent or translucent tape. The momentary position of tape 23 is registered by an optical code sensor 38 which may conveniently comprise a light source 37 and a multiple photo-diode or like receptor means, none of which requires to be set forth in any detail since this general type of coded positioning sensing and registration is well known in the art. The signal given by sensor 38 is used to actuate a drive motor 39 (see FIG. 6), which again is a matter of well-known technology. It is of course unnecessary to provide more than one of the display tapes with the coded edge portion since all of the tapes are in effect geared together and move simultaneously as already described. As is conventional in closed-loop positioning systems, a command signal is applied to the input according to the positioning desired, i.e. according to the character to be displayed. The command signal causes the drive motor 39 to be energized. The tapes are displaced in unison and the sensor 38 continuously produces a follow-up signal coresponding to the actual positioning of the tapes. The follow-up signal is compared with the command signal and when correspondence or equality is achieved, the motor is stopped and the selected character is displayed by the tapes. In a closed-loop system, precise positioning of the tapes may be achieved since the positioning code is applied to the tape itself and may be positionally correlated with the respective character segments distributed along the length of the tape. While positioning of the tapes by use of a closed-loop positioning system does circumvent certain positioning problems as will be discussed below, it is disadvantageous in certain respects. In particular, where two or more modules are to be used together and adapted to display different characters, it is necessary to use a separate positioning system for each module. Further, in a closed-loop system a failure in locating the correct positional code signal will result in the display of a wrong or garbled character, or perhaps, damage to the module. As will be discussed below, an open-loop type of positioning system is preferred and the module of this invention is adapted for such positioning.

For changing the display from one character to another, an open-loop control system is preferred. For this purpose, it is desirable that succeeding characters may be selected by advancing or reversing the tapes through equal increments of angular displacement of the driving rollers. This will enable two or more display modules to be operated from a single drive motor with individual clutches for each module. However, because the tape is wrapped in varying amounts on the rollers according to the tape positioning, the effective roller diameter varies and a given angular displacement of a roller does not correspond to the same lineal displacement of the tape. In the illustrative example, the relative dimensions have been chosen so that the effective diameter of the driving roller is such that one-fourth of a revolution forward from its home or reference position will take up a length of the tape equal to the axial length, L, of each window segment. (In this home position, the effective diameter includes the roller diameter plus any tape leader wound thereon.) Accordingly, the first revolution of the roller will take up the first four character segments. However, during the next revolution the roller will have an effective diameter which is larger by twice the thickness of the tape and will take up a length of tape greater than the next four character segments. The effective diameter of the roller continues to increase with approximately each succeeding group of four character segments. Thus, it can be seen, with reference to FIG. 4, that as the tape 23 is advanced or taken up further on the driving roller 15, each 90° increment of roller rotation will take up slightly more tape than the previous increment.

So that equal angular increments of roller displacement will provide accurate positioning of successive character segments, the character segments are nonuniformly spaced along the length of the tape. This is depicted in FIG. 8 which is a diagrammatic representation of tape 23 showing the front surface and back surface thereof side-by-side with the respective display window segments therebetween for showing the positional correlation. The front surface of the tape 23 is shown in fragmentary sections on the left side of FIG. 8 and these sections are enlarged relative to the showing of the front surface in FIG. *3a*. Similarly, the back surface of the tape 23 is shown in enlarged, fragmentary sections on the right side of FIG. 8. The back surface view in FIG. 8 shows the tape as it would appear if it were turned side-for-side from the front surface view, i.e. the tape is turned over by rotation about its longitudinal axis. (In FIGS. *3a* and *3b*, the tape in FIG. *3b* is turned end-for-end from the position shown in FIG. *3a*, i.e. it is turned over by rotation about a transverse axis.) The tape 23 comprises a leader 62 at one end thereof which is secured to the driving roller 15. It also comprises a leader 64 at the other end thereof which is secured to the slave roller 19. The tape 23, between the leaders, comprises a plurality of tape surface segments 66, each of which is of rectangular shape and extends the full width of the tape. The surface segments 66 in a group, A, are of the same length; the surface segments 66 in successive groups B, C, etc. are progressively longer. The shortest surface segments are adjacent the leader 62 and the longest are adjacent the leader 64. The surface segments 66 accommodate the various character segments, such as character segment 33 which is shown in actual configuration in FIG. 8 and in FIG. *3a*. The other character segments are represented in FIG. 8 in dummy form by the hatched sections, one of which is superposed upon each of the tape surface segments 66. It is noted that each of the character segments is allotted an axial length, C. This length, C, is suitably equal to the axial dimension of the shortest of the tape segments 66. The tape segments in each succeeding group are longer than those in the preceding group by an incremental length, so that an extension 68 is provided for the character segments, as indicated. This extension will vary from zero length for the character segments in the first group (group A) to a maximum length for the character segments in the last group. In practice, the extensions 68 are not left blank; instead, the character configuration is extended through that portion so as to avoid showing a blank line in a character display in case of a positioning error.

FIG. 8 also depicts the positional relationship of the front and back surfaces of the tape 23 in relation to a viewing window 70. The viewing window is an aperture or area bounded by the sides of the character segments and the top and bottom, respectively, of the uppermost and lowermost character segments. In the device as depicted in FIG. 2, the window 70 is defined by the opening in the front of the frame of the device. It is noted that in FIG. 8 the tape 23 is depicted as being laid flat alongside the window 70, whereas, in fact, the tape 23 is disposed within the window and is looped over the display rollers and partially wound on the driving and slave rollers. The window 70 is divided into plural window segments *72a*, *72b* and so forth, according to the total number of character segments to be displayed at a time. Each window segment has an axial length, L, equal to the axial length, C, of the character segments. It will be understood that the window segments are not separated by physical boundaries, instead, each window segment is an allotment of space from the total window area to a character segment which has the same relative position in the character format as the window segment has in the window area.

In FIG. 8, the tape 23 is shown in the same position relative to the display window 70 as it is in FIG. 2, i.e. the letter A is displayed and the character segment 33 is displayed in the window segment *72a*. The back side of the tape 23, as shown in FIG. 8, is comprised of tape surface segments 66' which are progressively longer, by groups, as described above with reference to the front surface. The character segments are all of the same length and the extensions 68' vary in the same manner as described above. With the tape 23 in the position for displaying the character A, as described, the character segment 34 is displayed in the window segment *72b*. The remaining segments of the character A will appear in the respective window segments as depicted in FIG. 2.

In the illustrative embodiment, it is to be noted that ninety degree increments of rotation of the driving rollers will successively present the successive character segments in accurate alignment with the respective window segments. It will be understood that the relative dimensions of the roller diameter and the character segments may be changed to suit a particular design.

The tape material is preferably a thin sheet stock which has high tensile strength and which is dimensionally stable under varying ambient temperature and humidity conditions. One preferred material is polyester film, such as that sold under the trademark "Mylar" by E. I. du Pont de Nemours of Wilmington, Delaware. Even with a thin tape, the wrap-up of the tape on the roller has a significant effect upon the accurate positioning of the character segments. It has been found that this problem of tape wrap-up is exaggerated by the use of small rollers. The small roller requires a large increment of roller rotation, as compared to a large roller, for producing a given character segment length. It can be shown that the length of successive tape segments for equal increments of roller rotation varies as the square of the angular increment. Accordingly, a large angular increment which is required for small rollers will result in a large variation in tape segment length and hence there will be inefficient use of the tape due to the unused space between character segments, i.e. the extensions 68 shown in FIG. 8 and described above. To minimize this effect, it is desirable to use large rollers. Further, the tape thickness will differ somewhat from the design value and this will contribute to positioning error. The positioning error due to tape thickness variation will vary with the square of the incremental angle of roller rotation for each character segment and with the square of the number of character segments. Therefore this error is minimized by the use of a larger roller. It is preferred that the roller diameter be made approximately equal to the sum of the distance spanned by two window segments, i.e. approximately equal to twice the distance between the points of tangency 11 and 12 in FIG. 2. This provides a tape segment angle of about 90° or about four tape segments per circumference.

Although an open-loop positioning system is advantageous in many respects, it does not provide absolute accuracy in positioning the tapes for the character displays. Accordingly, the foregoing features of character segment spacing and roller diameter are of great importance in producing characters with faithful reproduction, especially where a large number of characters, for example forty or so, are represented in a single module. Additionally, the fidelity of character reproduction is enhanced by proper selection of the number of segments per character. The number of segments per character should be selected so that each horizontal bar in a character is provided by one, and only one, character segment; further, such charcter segment should carry no portion of the character other than the horizontal bar. With this arrangement, the upper and lower edges of the horizontal bar necessarily occur at the cracks between segments. It has been found that this requirement is fulfilled best with eight segments per character because it permits proper relative positioning of the horizontal bars in all characters in all classes or fonts of character styles. It is found that six segments per character does not permit proper placement of the horizontal bars without fragmenting a bar, with parts on two segments per character is too many and horizontal bars would have to be fragmented to obtain proper placement.

In order to compensate for positioning errors of the character segments in displaying a given character, the appearance of misalignment is minimized by fairing of the character segments at the upper and lower extremities thereof. This is illustrated in FIG. 8 which shows the character segments 33 and 34. In these segments, for example, the character lines at the upper extremities 76 and at the lower extremities 78 are faired toward the vertical direction, i.e. the lines are diverted from the trend line of the character style to approach asymptotically a vertical line. Consequently, when two adjacent character segments are not accurately positioned the appearance of misalignment of the character trend line is minimized.

As described above, the driving rollers 15, 16, 17 and 18 are directly driven by the roller shafts and the slave rollers 19, 20, 21 and 22 are spring driven by the roller shafts to compensate for the disparity in the required angular rotation for linear payout and uptake in transferring tape from one roller to the other. The driving rollers are positioned immediately behind the window segments and the driven rollers are immediately behind the driving rollers. Each pair of driving and slave rollers, being of a diameter approximately equal to two window segments, is accommodated in the space of the projected area of the respective window segments. This enables the module to be of compact design within a rectangular box having a height and width substantially equal to that of the window.

Reverting again to the winding arrangement of the tapes, it is observed that the tape is always held in tension by reason of the spring loading in the slave roller. It is desirable to maintain the tape tension at a value such that it will be stretched tightly across the display rollers but, of course, the spring loading varies with the amount of tape windup on the driving roller. The spring loading is the smallest when most of the tape is on the slave roller and in this condition the spring torque, working against the friction in the tape and roller system, may tend to allow the tape to become somewhat slack across the display rollers. This is overcome in the winding arrangement, as shown in FIG. 4, by laying the loop of tape from the display rollers directly upon the driving roller. Note that for each set of rollers, the tape passes immediately from the driving roller over a first set of display rollers and thence is looped back over the driving roller in engagement therewith over more than 180° before it is passed over the second set of display rollers to the slave roller. This causes the driving roller to serve as a feed roller and obviates the need for idler rollers for looping the tape. As a feed roller it tends to keep the tape tight over the display rollers for both directions of rotation of the driving roller.

With the character segments disposed on the tape as described above, the display is changed from one character to another by the rotation of any of the driving rollers by one-quarter turn, that is, by 90°, for the relative proportions of particular apparatus depicted in the drawings. On FIG. 6, four index marks 45, 46, 47 and 48 are shown on the face of gear 27, and it will be clear from the foregoing that the display can be changed by rotating the driving/slave gear assembly by 90°. This may readily be done by hand with the aid of either knob 50 on the face of gear 27 or knob 51 on the face of gear 35. Exact positioning is facilitated by observing the four index markings on the face of gear 27. Remote control of rotation may of course be effected by any of the means well known to those skilled in the art, such as by use of cables, pulleys and the like.

Such repositioning of the display by hand is adequate in many cases, such as for an installation where the display is changed infrequently. In many other cases, however, it is desirable to be able to reposition the display device automatically. Needless to say any device of which many are well known in the automatic positioning art, which will selectively effect rotation of a driven rotational element to any of a selected positioning differing by multiples of 90°, may be employed.

A form of open-loop control system is shown in FIG. 6. A coding dial 40 is geared into the roller array through intermediate gear 41, and bears an annular coding strip 42. FIG. 7 is a top view of the coding dial 40 showing a light source 43 and an optical sensor means 44, which operates to produce a unique control signal at each 90° increment of rotation of the driving rollers over a range of several revolutions of the driving rollers. Each of the unique control signals corresponds with one of the character segments on the set of tapes and the control signals are applied through a motor control means to the motor drive 39. The control means is operative to permit selection of any one of the control signals, and hence the corresponding character, so that the tapes are automatically positioned by the motor drive.

An open-loop control system especially adapted for use with the display device of this invention is disclosed in copending application Ser. No. 547,081 filed Feb. 4, 1975, which is hereby incorporated by reference into this application.

A modification of the invention is shown in FIGS 9 and 10. In this embodiment of the invention, the tapes are wound upon and displayed from the surfaces of the driving and slave rollers; the display rollers used in the embodiment of FIG. 2 are dispensed with. Referring to FIGS. 9 and 10, the display module 80 comprises a frame 82 and plural sets of driving and slave rollers. Each driving roller 84, 85, 86 and 87 is directly connected with its respective shaft and carries a gear 88, 89, 90 and 91 which is fixedly connected therewith. Each of the slave rollers 92, 93, 94 and 95 is spring loaded in the same manner as slave roller 19 described with reference to FIG. 5. Each of the slave rollers is connected through a spring loaded shaft with respective gears 96, 97, 98 and 99. An input gear 101 is manually operable by a crank 102 and is meshed directly with gear 97 of the slave roller 93. All of the driving and slave rollers are of the same diameter and all of the gears, except the input gear 101, are of the same size. It is noted that the rollers are of a diameter approximately equal to a single window segment of the display where a window segment is that portion of the total display area which is allotted to a single character segment. A tape 103 has one end secured to the driving roller 84 and the other end secured to the slave roller 92, the tape being wound between the rollers in an "S" configuration. Similarly, a tape 104 is connected between the driving roller 85 and the slave roller 93, the tape 105 is connected between the driving roller 86 and the slave roller 94 and the tape 106 is connected between the driving roller 87 and the slave roller 95. The various characters represented by the module are displayed successively by rotation of the input gear through successive angular increments of equal value.

Although the description of this invention has been given with reference to a particular embodiment, it is not to be construed in a limiting sense, many variations and modifications will now occur to those skilled in the art. For a definition of the invention reference is made to the appended claims.

The embodiments of the present invention in which an exclusive property or privilege is claimed are defined as follows:

1. A sign module for forming a display of a set of alphanumeric characters one at a time in a viewing window, said module comprising: a set of display tapes, each tape being imprinted on both front and back surfaces at discrete surface segments along its length with a discrete character segment of one character, all character segments on the front surface of a given tape corresponding to the same relative part of the different characters, and all character segments on the back surface of a given tape corresponding to the same relative part of the different characters, the number of display tapes in the set being equal to one-half the number of character segments presented at a time in said viewing window, a driving roller and a slave roller for each tape connected with opposite ends of the respective tape and supporting the respective tape with one surface segment of each surface being displayed in said window at a portion of the window which is in positional correspondence with the character segment represented, the surface segments on both surfaces of each tape being progressively longer from one end of the tape to the other, the character segments being nonuniformly spaced along the length of the tape whereby equal angular displacements of the driving roller causes successive character segments to be aligned with the respective window portions, the set of surface segments being displayed together in said window all bearing different character segments of the same character whereby an entire character is displayed, and means for displacing the driving rollers simultaneously through equal angles for displacing said tapes in unison along their length to successively present the character segments in registry with the respective window portions whereby the characters of said set are successively displayed, each of the driving rollers and each of the slave rollers being mounted upon a shaft, and means for displacing including a set of driving roller gears with each one of the driving roller gears being connected with the shaft of a respective one of said driving rollers and a set of slave roller gears with each one of the slave roller gears being connected with the shaft of a respective one of said slave rollers, each of the driving roller gears engaging one other driving roller gear and engaging the slave roller gear of the same tape, and each of the slave roller gears engaging one of the other slave roller gears, and means for rotating one of the roller gears whereby all gears rotate only in unison, each of said slave rollers being provided with a spring drivingly connected between the roller and its respective shaft whereby the tape on each pair of driving and slave rollers is maintained in tension and differential rotation between a slave roller and its shaft is taken up by the respective spring.

2. The invention as defined in claim 1 wherein eight character segments are presented at a time in said viewing window.

3. The invention as defined in claim 1 wherein the diameter of said rollers is approximately equal to the length of two character segments along the length of the tape.

4. The invention as defined in claim 3 including two pairs of display rollers for each display tape and having their axes all in one plane, the driving roller and the slave roller being disposed behind said plane with one of the driving and slave rollers being behind the other, said display tape extending from said driving roller and thence over the first pair of display rollers, back over said driving roller and thence over the second pair of display rollers and thence finally to said slave roller.

* * * * *

UNITED STATES PATENT OFFICE

CERTIFICATE OF CORRECTION

Patent No. 4,064,503 Dated December 20, 1977

Inventor(s) William H. Saylor and James O. Narey

It is certified that error appears in the above-identified patent and that said Letters Patent are hereby corrected as shown below:

Col. 2, line 15 (Spec. pg. 3, line 8), "whose" should be --whole--. Col. 2, line 28, (Spec. pg. 3, line 21) "527,997" should be --527,977--. Col. 3, line 22, (Spec. pg. 5, line 16) "numnber" should be --number--. Col. 3, line 44 (Spec. pg. 6, line 4), "invention" should be --inventive--. Col. 4, line 22, (Spec. pg 7, line 16), "display rolles" should be --display rollers--. Col. 6, line 21, (Spec. pg. 11, line 17), "coresponding" should be --corresponding--. Col. 9, line 27, (Spec. pg. 17, line 24), after "two segments" insert --; ten segments--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*